United States Patent [19]

Ashdown et al.

[11] 4,257,357

[45] Mar. 24, 1981

[54] FURNACES

[75] Inventors: Ronald A. Ashdown, Surrey; Gerald Mannasseh, London, both of England

[73] Assignee: Foster Wheeler Energy Corporation, Livingston, N.J.

[21] Appl. No.: 4,137

[22] Filed: Jan. 17, 1979

[30] Foreign Application Priority Data

Jan. 16, 1978 [GB] United Kingdom ..... 1696/78

[51] Int. Cl.[3] ..... F22B 15/00

[52] U.S. Cl. ..... 122/235 B; 122/235 A; 122/6.5; 122/6.6

[58] Field of Search ..... 122/235 R, 235 A, 235 B, 122/6.5, 6.6

[56] References Cited

U.S. PATENT DOCUMENTS

| | | | |
|---|---|---|---|
| 3,127,738 | 4/1964 | Hasbrouck et al. | 122/235 B |
| 3,144,855 | 8/1964 | Spellman | 122/235 B |
| 3,233,597 | 2/1966 | Svendsen | 122/235 B |
| 3,867,909 | 2/1975 | Brown | 122/235 B |
| 3,875,904 | 4/1975 | Astrom | 122/235 B |
| 3,892,191 | 7/1975 | Welden, Jr. et al. | 122/235 B |
| 4,116,168 | 9/1978 | Gorzegno et al. | 122/510 |

*Primary Examiner*—Henry C. Yuen

*Attorney, Agent, or Firm*—Marvin A. Naigur; John E. Wilson; John J. Herguth, Jr.

[57] ABSTRACT

A furnace in which burners are incorporated into water-cooled tube panels without the need for heavy steel castings, the furnace including one or more walls formed of upright tubes having fins connecting adjacent tubes, some of said tubes and associated fins in said wall or walls for at least part of their length being outwardly, with respect to the interior of the furnace, out of line with other tubes in said wall to define upright recesses, fuel nozzles and openings for the entry of combustion air being provided through the portions of said fins which define in part the upright recesses, the arrangement of said fuel nozzles and said openings being adapted such that fuel supplied from said fuel nozzles and combustion air supplied from said openings enter the recesses in converging streams.

5 Claims, 4 Drawing Figures

FURNACES

Figure 1:
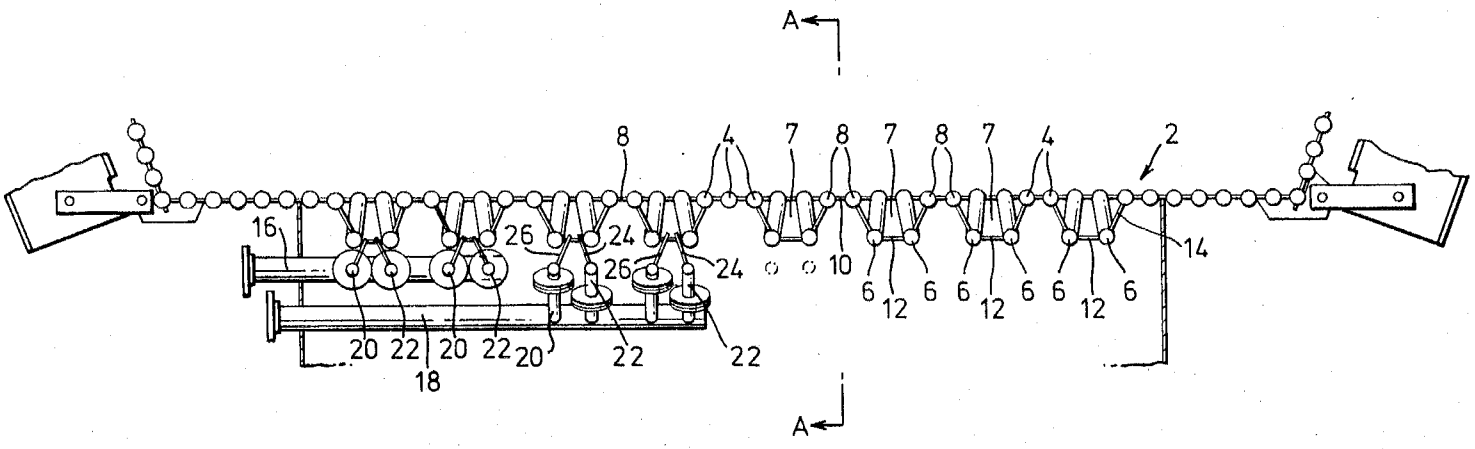

This invention relates to heat generating apparatus.

Many conventional furnaces burning carbonaceous fuels in solid, liquid or gas form are lined with water tubes for absorbing the heat. In a gas fired furnace the burners are generally formed from hollow castings of stainless steel which are attached to water tubes. These castings are heavy and expensive and often require considerable associated pipe work to supply the fuel gas.

The present invention provides a system in which burners may be incorporated into water cooled tube panels without the need for heavy steel castings.

Therefore according to the present invention there is provided a furnace which is defined at least in part by one or more walls formed of upright tubes with fins connecting adjacent tubes, the wall or walls having some tubes which for at least part of their length are outwardly, with respect to the interior of the furnace, out of line with the other tubes in the wall to form upright recesses, fuel nozzles and openings for the entry of combustion air being provided through the portions of fins which define in part the upright recesses, the arrangement of fuel nozzles and opening being such that the fuel and combustion air enter the recesses in converging streams.

Preferably the fins connecting the out of line portions of tubes with other tubes in the wall have openings for entry of cumbustion air. The fuel nozzles and air inlets are preferably level with each other.

The invention provides a system in which burners may be incorporated into a wall of water-cooled tube panels formed of upright tubes joined by fins without the need for heavy steel castings. The fuel nozzles and air inlets are arranged so that the fuel and air streams converge in the region of the recesses to thoroughly mix the fuel and air for optimum combustion. The resesses act as mixing zones for the streams.

The system of the present invention is useful for furnaces, e.g., in steam generation plants, and also for transition chambers utilizing waste gases e.g., from turbines. The term 'furnace' as used herein includes transition chambers and the like.

In one embodiment of the invention the upright recesses or mixing zones are formed by a pair adjacent of adjacent tubes being set back for at least part of their length, said pairs of these adjacent tubes having a first fin joining each other and each having a second fin joining an adjacent tube in the wall, the second fins having the cut-away portions for entry of combustion air.

The fuel nozzles may conveniently be positioned projecting from the back of the mixing zone through the fin connecting the two out of line tubes.

The air inlets are formed by the cut-away portions in the fins joining the out of line tubes with adjacent tubes in the wall (referred to as second fins). The cut-away portions in one second fin of a pair may be at the same level as the cut-away portions of the other second fin or may be staggered i.e. the cut-away portion of one fin being at the same level as a solid portion of the other fin.

Figure 2:
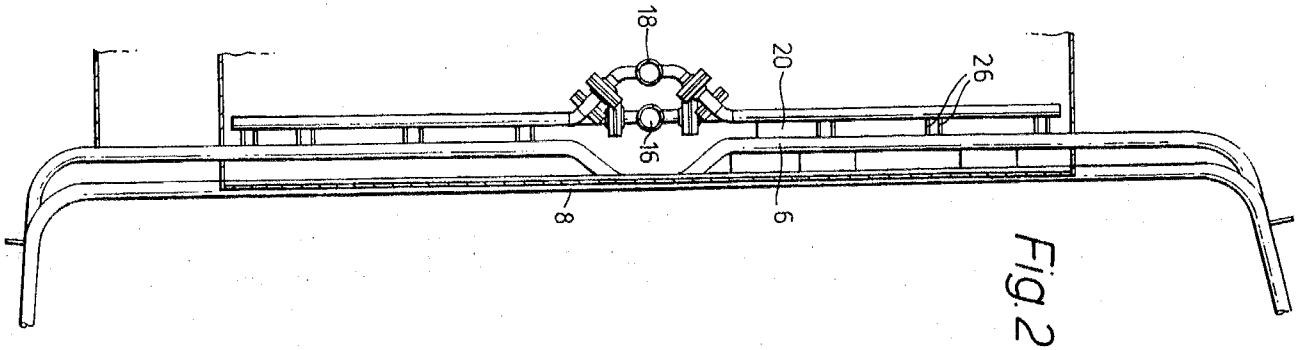
Figure 4:
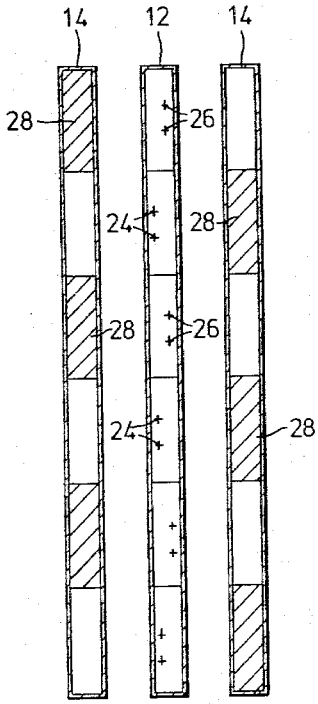
Figure 3:
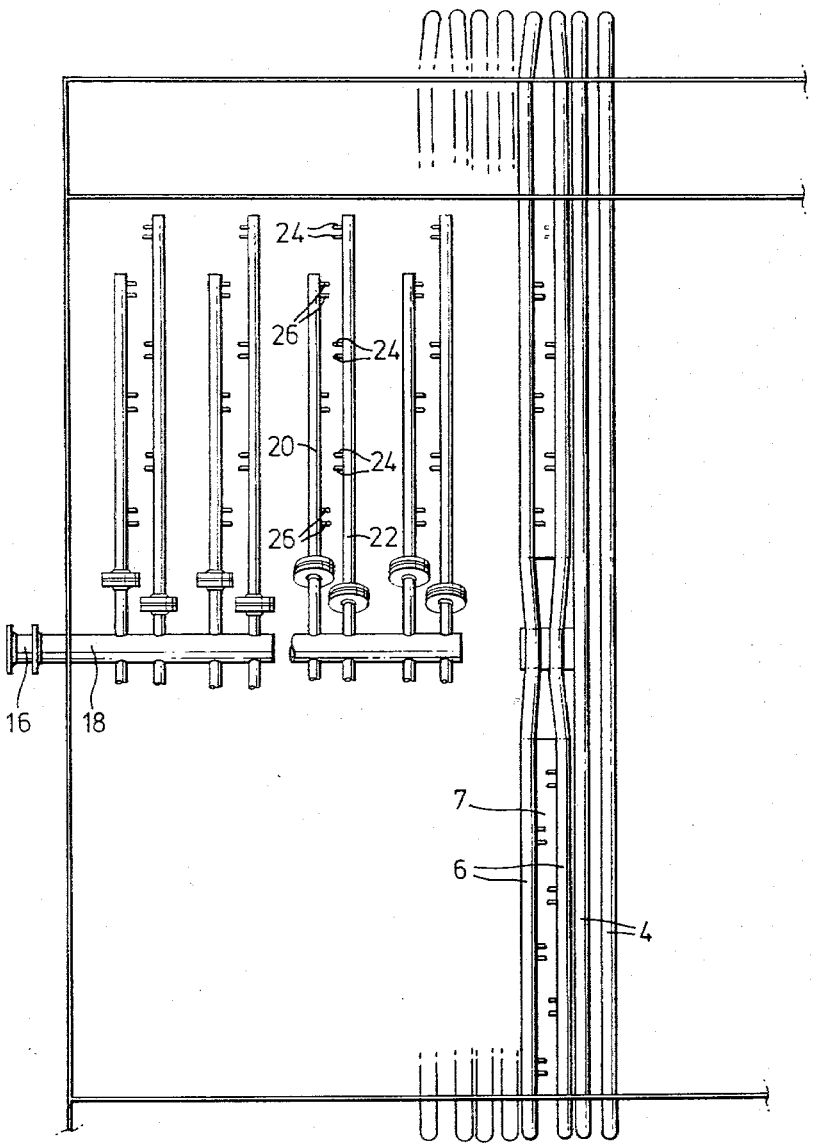

The invention will now be further described with reference to the accompanying drawings in which:

FIG. 1 represents a sectional plan view of a furnace wall showing the tube and fuel nozzle arrangement in accordance with the invention, FIG. 2 represents a section along line A—A of FIG. 1, FIG. 3 represents a front elevation of the furnace wall of FIG. 1 with a number of tubes omitted for clarity, and FIG. 4 schematically represents one arrangement of burners and air inlets in accordance with the invention.

Referring to FIGS. 1 to 3 the furnace wall 2 comprises a row of upright tubes 4 joined together by fins. Some of the upright tubes are outwardly out of line with respect to the interior of the furnace for at least part of their length 6 to form mixing zones 7 other tubes 8 remain in the plane of the wall throughout their length. Adjacent tubes 8 are joined by fins 10. The out of line portions 6 of the tubes are joined by fins 12 (referred to as first fins) and the out of line portions are joined to in line tubes 8 by fins 14.

A pair of gas pipes 16 and 18 provide gaseous fuel which is conducted along pipes 20 and 22 of smaller bore. From the pipes 20 and 22 extend pairs of fuel nozzles 26 and 24 respectively. Each pair of fuel nozzles projects through a fin 12 at the back of the mixing zone. The pairs of fuel nozzles 24 are set an angle to fin 12 and towards one edge of the fin and the pairs of fuel nozzles 26 are set at an opposite angle towards the other edge of the fin. The pairs of nozzles 24 and 26 are arranged in a staggered relationship with each other down the length of the mixing zone as clearly shown in FIG. 3.

The fins 14 are provided with cut-away portions to form inlets for combustion air. FIG. 4 is a schematic representation of the arrangement of nozzles and air inlets in FIGS. 1 to 3. The nozzles 26 and 24 are represented by crosses and the cut-away portions 28 are cross-hatched. The cut-away portions on one fin 14 are staggered relative to those on the other fin 14 of a pair and positioned such that air entering from the cut-away portion and fuel entering from the nozzles impinge.

The system of the invention simplifies the conventional burner-tube arrangement in furnaces and transition chambers. Furthermore it can simplify the buckstay arrangement for the furnace in that the buckstay may be brought across to the centre of the front wall with the use of suitable insulation avoiding the use of a ring structure around the gas duct which would be required to take the sidewall buckstays. A further advantage is that the amount of gas piping in the exhaust gas ducting is reduced compared with many prior arrangements.

What is claimed is:

1. A furnace having a substantially vertical wall comprising a plurality of generally vertically extending tubes for placing fluid in indirect heat exchange with the heat generated within the furnace and fins extending between said tubes, said tubes including a plurality of first straight tubes and a plurality of second tubes having a portion outwardly offset from the wall, said wall having a plurality of upright concave recesses open to the interior of the furnace, each of said recesses being defined by the outwardly offset portions of a plurality of said second tubes, second fins extending between each of said outwardly offset portions and between said outwardly offset portions and said first straight tubes, a fuel nozzle disposed in one of said second fins of each recess to feed fuel into said recess, an opening defined in another one of said second fins of each recess for the entry of combustion air into said furnace, the second fin in which the fuel nozzle is disposed and the second fin having the opening for combustion air being disposed at an angle to one another, so that fuel supplied from said fuel nozzle and combustion air supplied from said opening will enter into the recess in converging streams.

2. A furnace according to claim 1 wherein said fuel nozzles and said openings for combustion air are positioned at the same level.

3. A furnace according to claim 1 wherein said another one of said second fins of each recess has a plurality of openings for entry of combustion air.

4. A furnace according to claim 3 wherein said fuel nozzles protrude through said second fins in which they are disposed.

5. A furnace according to claim 4 wherein openings for the entry of combustion air are disposed in a plurality of second fins of each recess, the openings in one of said second fins being at the same level as solid portions of another of said second fins.

* * * * *